US005793396A

United States Patent [19]

Sasaki

[11] Patent Number: 5,793,396

[45] Date of Patent: Aug. 11, 1998

[54] INK-SUPPLY CONNECTING MEMBER AND INK EJECTION SYSTEM

[75] Inventor: Toyonori Sasaki, Anjo, Japan

[73] Assignee: Brother Kogyo Kabushiki Kaisha, Nagoya, Japan

[21] Appl. No.: 702,189

[22] Filed: Aug. 23, 1996

Related U.S. Application Data

[63] Continuation-in-part of Ser. No. 531,773, Sep. 21, 1995, Pat. No. 5,745,139.

[30] Foreign Application Priority Data

| | | | |
|---|---|---|---|
| Dec. 12, 1994 | [JP] | Japan | 6-307599 |
| Jun. 2, 1995 | [JP] | Japan | 7-136818 |
| Aug. 30, 1995 | [JP] | Japan | 7-246692 |

[51] Int. Cl.[6] ..... B41J 2/175

[52] U.S. Cl. ..... 347/86; 215/341; 215/343; 220/378

[58] Field of Search ..... 347/86, 87; 141/383, 141/386, 85, 88, 18; 222/325, 108; 215/341, 343, 344, 345, DIG. 1; 220/378

[56] References Cited

U.S. PATENT DOCUMENTS

| | | | |
|---|---|---|---|
| 2,722,346 | 11/1955 | Yokota | 222/108 |
| 3,190,481 | 6/1965 | McKnight, Jr. | 215/345 |
| 5,155,502 | 10/1992 | Kimura et al. . | |

FOREIGN PATENT DOCUMENTS

| | | | |
|---|---|---|---|
| A2-0 625 424 | 11/1994 | European Pat. Off. . | |
| A-2-187364 | 7/1990 | Japan . | |
| 5-338191 | 12/1993 | Japan | 347/86 |
| A-6-328711 | 11/1994 | Japan . | |

OTHER PUBLICATIONS

IBM Technical Disclosure Bulletin; Replaceable ink cartridge for ink jet print head; pp. 459–462, Jun. 1991.

*Primary Examiner*—Benjamin R. Fuller
*Assistant Examiner*—Charlene Dickens
*Attorney, Agent, or Firm*—Oliff & Berridge, PLC

[57] ABSTRACT

An ink-supply connecting member for supplying ink from an ink cartridge formed with an ink-supply port to a print head formed with a plurality of jet nozzles, the ink-supply connecting member comprising: a connection manifold portion including: a small-diameter tubular portion connected to the print head and formed with an ink-supply channel for supplying ink to the jet nozzles of the print head and a large-diameter portion connected to the small-diameter portion and formed with an ink intake port in fluid communication with the ink-supply channel; and a seal member sealingly fitting into the small-diameter portion of the connection manifold portion and abutting the large-diameter portion.

22 Claims, 7 Drawing Sheets

INK-SUPPLY CONNECTING MEMBER AND INK EJECTION SYSTEM

This application is a continuation-in-part of application Ser. No. 08/531,773, filed Sep. 21, 1995 now U.S. Pat. No. 5,745,739.

BACKGROUND OF THE INVENTION

1. Field of the Invention

The present invention relates to an ink-supply connecting member for an ink jet printer and more particularly to an ink-supply connecting member for supplying ink from detachable ink cartridges to a print head via a connecting manifold.

2. Description of the Related Art

There has been known an ink jet printer for printing dot patterns by ejecting droplets of ink and including a head unit formed from an integral print head and tubular connecting manifold portion formed with an ink-supply passage. A plurality of ejection nozzles are formed in the print head. The tubular connecting manifold portion is for supplying ink from an ink cartridge to the print head through the ink-supply passage. The head unit is attached to a head holder formed with an attachment hole through which the tubular connecting portion protrudes. An ink cartridge containing ink is detachably mounted to the head holder and the head holder is mounted on a reciprocally moving carriage.

Japanese Patent Application (Kokai) HEI-6-328711 describes a head unit for use with four print heads to allow printing in full color. Each of the print heads has a substantially tubular ink-supply tube formed with an ink-supply passage in fluid connection with nozzles of the print heads. Four attachment holes, one for each print head, are formed in the head unit. To mount the print heads to the head unit, each ink-supply tube is passed through a corresponding attachment hole. A joint seal is fitted around each ink-supply tube and fixed between the supply tube and its corresponding print head using adhesive. The sealing joints are for preventing ink supplied from the mounted ink cartridge units from seeping between the ink-supply tubes and corresponding print heads. Contact points of a flexible print circuit board connecting each print head with a controller unit can be protected from coming in contact with the ink and so will not corrode.

SUMMARY OF THE INVENTION

However, in the ink jet printer disclosed in Japanese Patent Application No. HEI-6-328711, the adhesive used to adhere the print head unit to the ink-supply tubes is normally a type that hardens at room temperature, such as an oil-resistant silicone adhesive. Not only is it necessary to perform operations required to adhere the print head unit to the ink-supply tubes, but this type of adhesive takes one to three hours to dry completely. This makes the head unit time consuming and costly to produce.

FIG. 1 shows a conceivable example for preventing ink contained in an ink cartridge 140 from seeping out and staining the surrounding area when the ink cartridge 140 is mounted in a head holder 131. A head unit 132 attached to the head holder 131 includes a print head 133 and a connecting manifold portion 134 formed integrally together. The print head 133 is formed with a plurality of ejection nozzles. The connecting manifold portion 134 is formed in a tubular shape with an ink-supply passage **134*a* for supplying ink to the print head 133. The head unit 132 is attached to the head holder 131 by passing the connecting manifold portion 134 through an attachment hole 131*b* formed in the head holder 131. A tubular seal member 135 is sealingly fitted to the outer periphery of the connecting manifold portion 134. The seal member 135 is provided with a flange portion 135*f* at its tip nearest the print head 133. When the ink cartridge 140 is mounted in a predetermined mounting position indicated by the two-dot chain line of FIG. 1, the connecting manifold portion 134 is inserted into an ink-supply port 140*a* of the ink cartridge 140 until the seal member 135 abuts against the peripheral surface surrounding the ink-supply port 140*a***.

However, because the seal member 135 is sealingly fitted to outer periphery of the cylinder-shaped connecting manifold portion 134, the ink-supply port **140*a* must be formed with a large diameter D in order to receive the seal member 135 therein. As a result, when the ink cartridge 140 is mounted on the head holder 131, a great deal of ink will leak through the ink-supply port 140*a*. Also, while the ink cartridge 140 is in a mounted condition on the head holder 131, a small amount of ink will leak from the ink cartridge 140 by capillary action even though the seal member 135 is sealingly abutted against the connecting manifold portion 134. This ink can seep through curve-shaped gaps between the connecting manifold portion 134 and both the seal member 135 and attachment hole 131*b*. The ink could seep to contact points of a flexible print circuit board (not shown in the drawings) connecting the print head 133 to a controller unit. Furthermore, when the ink includes glycerin, it can lubricate the fit between the connecting manifold portion 134 and the seal member 135 by seeping therebetween. When the ink cartridge 140 is detached from the head holder 131, the seal member 134 can also slip off the connecting manifold portion 134**.

It is an objective of the present invention to overcome the above-described problems and provide an ink jet printer wherein a seal member can be simply attached to a connecting manifold portion so that the head unit is easier to produce and wherein the seal member has greater sealing properties.

In order to achieve the above-described objectives, an ink-supply connecting member according to the present invention for supplying ink from an ink cartridge formed with an ink-supply port to a print head formed with a plurality of jet nozzles, the ink-supply connecting member comprising: a connection manifold portion including: a small-diameter tubular portion connected to the print head and formed with an ink-supply channel for supplying ink to the jet nozzles of the print head and a large-diameter portion connected to the small-diameter portion and formed with an ink intake port in fluid communication with the ink-supply channel; and a seal member sealingly fitting into the small-diameter portion of the connection manifold portion and abutting the large-diameter portion.

With this configuration, a connecting manifold portion is provided with a small-diameter portion and a large-diameter portion connected at a step portion. Also, a seal member is sealingly fitted around the periphery of the small-diameter tubular portion so as to abut against the large-diameter portion. Also, the seal member is in sealing contact with both the small-diameter tubular portion and the large-diameter portion and seals any spaces between the connecting manifold portion and an ink cartridge receiving the connecting manifold portion. The seal member can provide good seal without the need to adhere the seal member with adhesive. Also, the seal member can be prevented from slipping off the connecting manifold portion when the ink cartridge is detached.

According to another aspect of the present invention, the seal member is fitted to the outer periphery of the small-diameter tubular portion. Therefore, the outer diameter of the seal member will not be much greater than the outer diameter of the large-diameter portion. An ink-supply port of the ink cartridge into which the connecting manifold is received can be formed small so that leaks from the ink cartridge can be reliably prevented from occurring when the ink cartridge is mounted.

According to another aspect of the invention, a first flange portion is formed integrally to the rear tip of the seal member. The first flange portion covers an attachment hole formed in a head holder supporting the print head and the connecting manifold member and through which the large-diameter portion passes when the connecting manifold portion is attached to the head holder. Also, when the ink cartridge is mounted to the head holder so that the large-diameter portion is inserted into the ink-supply port, the first flange portion abuts against the wall surrounding the ink-supply port of the ink cartridge and seals the gap between the ink cartridge and the attachment hole. Therefore, ink will not leak from the ink-supply port through the attachment hole toward the print head so that the contact points of a flexible circuit board connected to the print head can be prevented from corroding.

According to still another aspect of the invention, the seal member is sandwiched between the head holder and a step portion, formed between the small-diameter tubular portion and the large-diameter portion of the connecting manifold portion. Therefore, the seal member can be reliably maintained in a predetermined seal position between the step portion and the head holder.

According to a further aspect of the invention, the seal member includes a tubular portion sealingly fitted around the small-diameter tubular portion and a second flange portion integrally formed to a tip of the tubular portion. Therefore, when the ink cartridge is mounted, the second flange portion is bent by the outer periphery of the ink-supply port to bend and abut against the tubular portion so as to be fitted in the ink-supply port in a compressed condition. This reliably prevents ink from travelling through the gap between the small-diameter tubular portion of the connecting manifold member and the tubular portion of the seal member by capillary action.

According to a still further aspect of the invention, a slanting guide surface is formed in the ink cartridge in connection with the surface surrounding the ink-supply port. Therefore, when the ink cartridge is mounted, the second flange portion is smoothly guided by the slanting guide surface from its base portion without being damaged.

Also an ink ejection system according to the present invention comprises: a print head formed with a plurality of jet nozzles for ejecting ink; a connection manifold portion connected with the print head and including: a small-diameter tubular portion connected to the print head and formed with an ink-supply channel for supplying ink to the jet nozzles of the print head and a large-diameter portion connected to the small-diameter portion and formed with an ink intake port in fluid communication with the ink-supply channel; a seal member sealingly fitting into the small-diameter portion of the connection manifold portion and abutting the large-diameter portion; a head holder to which the print head and the connection manifold are attached, the head holder being formed with an attachment hole sufficiently large for the large-diameter portion of the connection manifold portion to pass through, the print head and the connection manifold portion being disposed on opposite sides of the attachment hole; and an ink cartridge formed with an ink-supply port receiving the large-diameter portion of the connection manifold portion.

BRIEF DESCRIPTION OF THE DRAWINGS

The above and other objects, features and advantages of the invention will become more apparent from reading the following description of the preferred embodiment taken in connection with the accompanying drawings in which:

FIG. 7(*b*) is a cross-sectional view showing details of the ink-supply connecting member when the ink cartridge is in a mounted condition on the ink-supply connecting member.

DETAILED DESCRIPTION OF THE PREFERRED EMBODIMENTS

Figure 1:
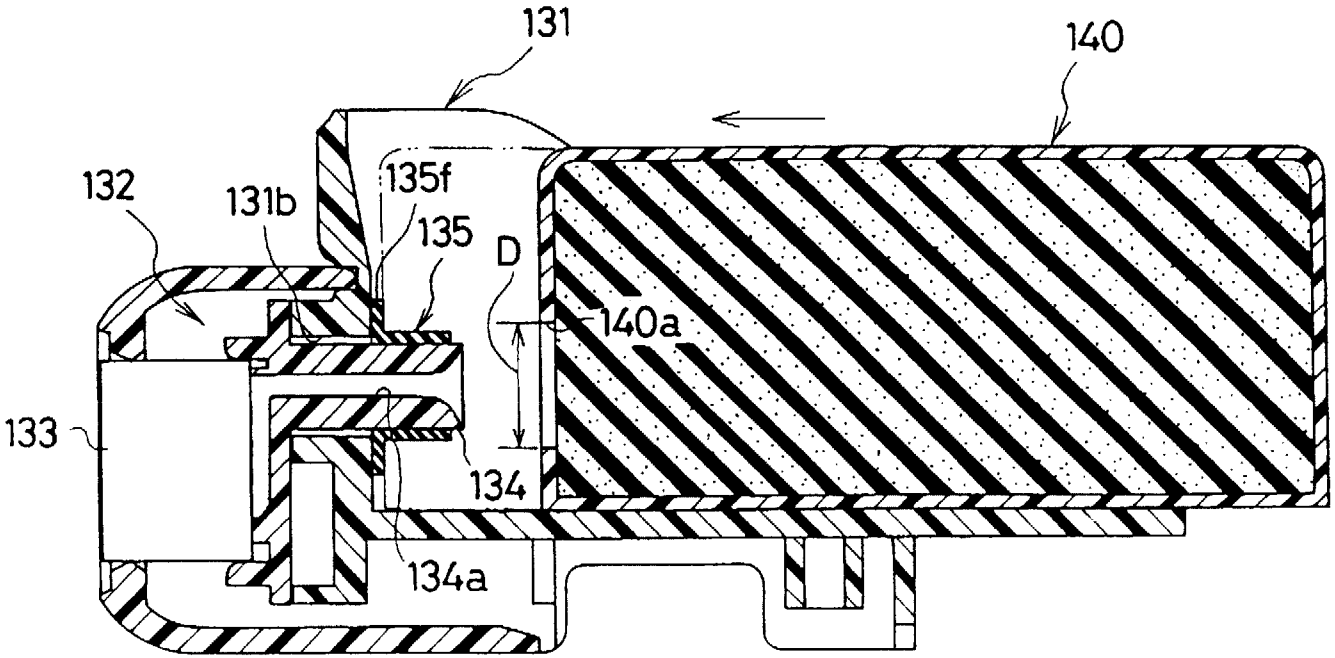
FIG. 1 is a cross-sectional view showing a conceivable ink ejecting system.

An ink jet printer according to a preferred embodiment of the present invention will be described while referring to the accompanying drawings wherein like parts and components are designated by the same reference numerals to avoid duplicating description. In the following description, unless stated otherwise directional terms, such as left, right, front, rear, up, and down will refer to configuration and orientation of components when the ink jet printer is in an orientation in which it is meant to be used.

Figure 2:
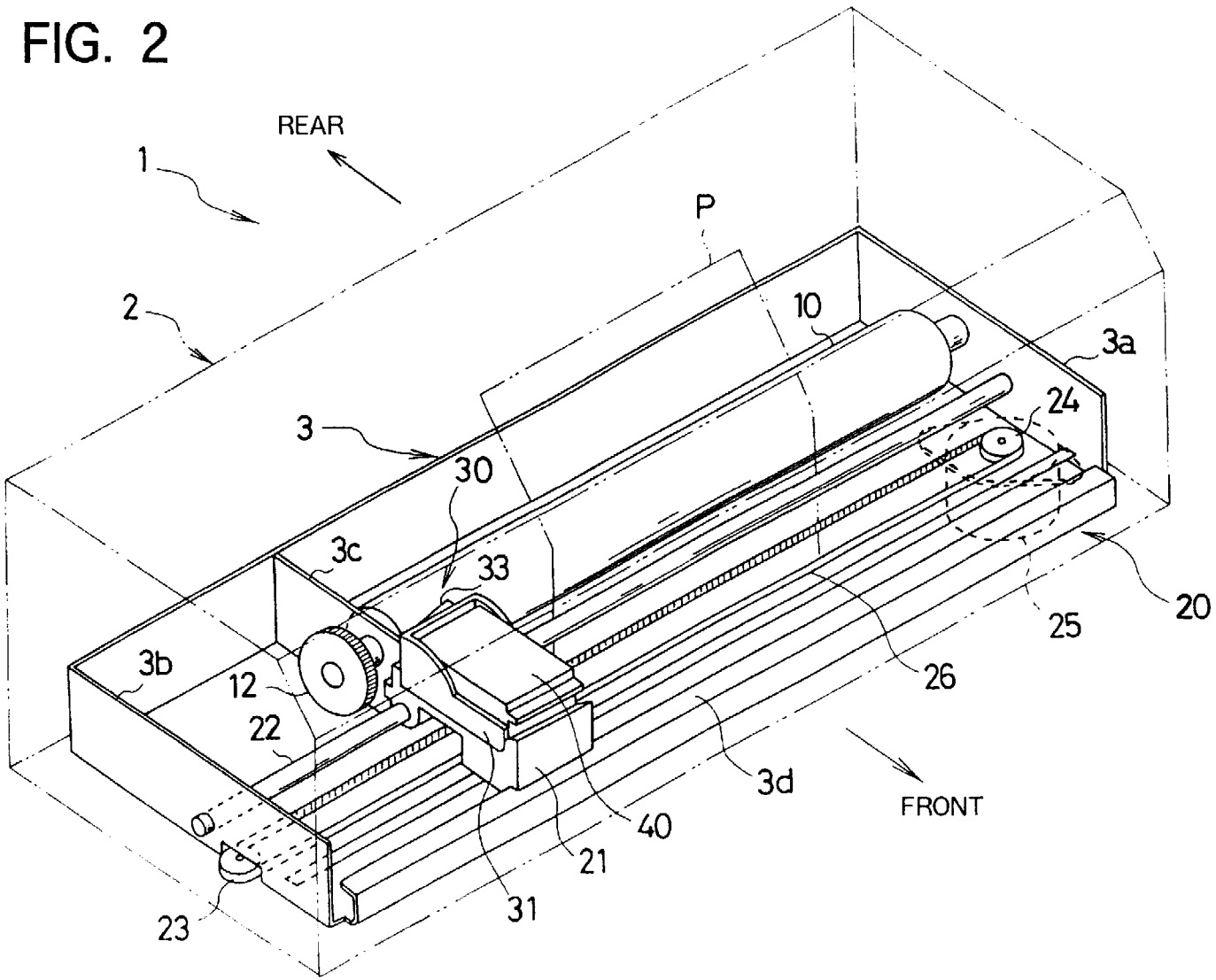
FIG. 2 is a perspective view partially in phantom showing an ink jet printer including an ink ejection system according to an embodiment of the present invention.

The present embodiment describes the present invention applied to an ink jet printer for recording images by ejecting ink droplets from a print head supplied with ink from a detachably mounted ink cartridge. As shown in FIG. 2, an ink jet printer 1 includes a frame 3 provided within a cover 2; a platen 10; a carriage drive mechanism 20 for driving a carriage 21; and an ink ejection mechanism 30 for ejecting toward a print sheet P ink contained in an ink cartridge 40.

Figure 3:
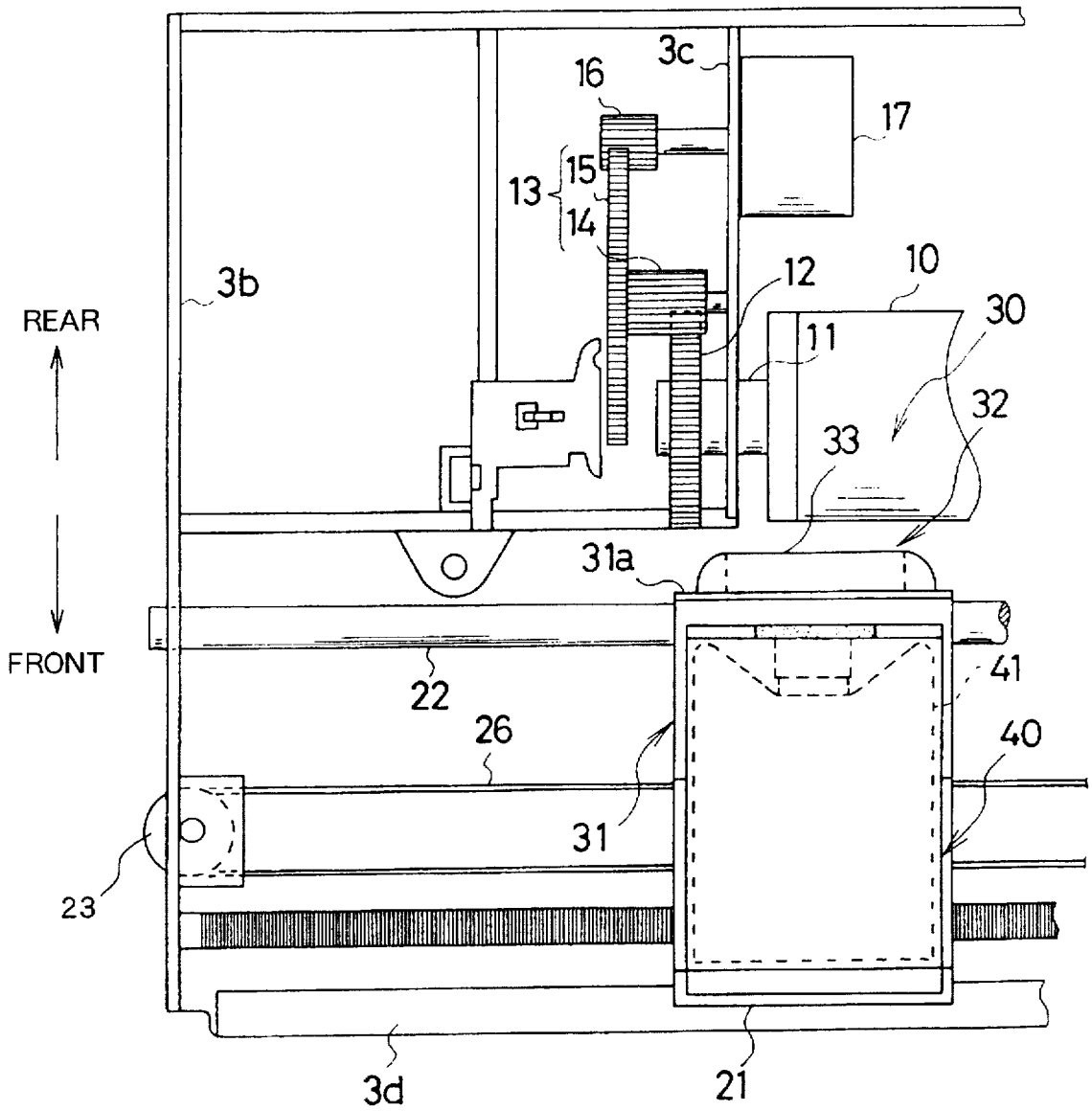
FIG. 3 is a plan view showing essential components in the vicinity of the ink ejection system.

The platen 10 includes a platen shaft 11 extending leftward and rightward as viewed in FIG. 3 and a rubber material surrounding the platen shaft 11. The platen 10 is rotatably supported by the right and left tips of the platen shaft 11 on side walls 3*a*, 3*c* of the frame 3 respectively. A platen gear 12 is fixed to the left tip of the platen shaft 11. A compound gear 13 including a first slave gear 14, meshingly engaged with the platen gear 12, and a second slave gear 15 is rotatably supported on the side wall 3*c*. A drive gear 16 meshingly engaged with the second slave gear 15 is fixed to the shaft of a feed motor 17. With this configuration, when the feed motor 17 is given to rotate in a predetermined direction, the drive gear 16 rotates in the same direction. This rotates the platen gear 10 via the compound gear 13 and the platen gear 12 so that a print sheet P is fed in a predetermined sheet feed direction.

Next, an explanation for the carriage drive mechanism 20 will be provided while referring FIGS. 2 and 3. A carriage 21 is disposed in a horizontal posture in front of the platen 10. A guide rod 22 and a guide rail portion 3*d* are supported on the frame 3 in parallel with the platen 10. The carriage 21 is mounted at its front edge on the guide rod 22 and at its rear edge on the guide rail portion 3*d* so as to be freely reciprocally movable leftward and rightward. The guide rail portion 3*d* is disposed at the front edge portion of the frame 3.

An idle pulley 23 is rotatably supported on the side wall 3*b* at the left-most edge of the movement range of the carriage 21. A drive pulley 24 attached to the drive shaft of a carriage drive motor 25, such as a stepping motor, is provided to the right-most edge of the movement range of the carriage 21. An endless timing belt 26 is suspended between the pulleys 23, 24. The timing belt 26 is attached to the lower edge of the carriage 21. With this configuration, when the carriage drive motor 25 is driven to rotate, the carriage 21 is driven by the pulleys 23, 24 and the timing belt 26 while supported on the guide rod 22 and guide rail portion 3*d* to move reciprocally in a print direction, that is, rightward, and a reverse direction, that is, leftward.

Figure 4:
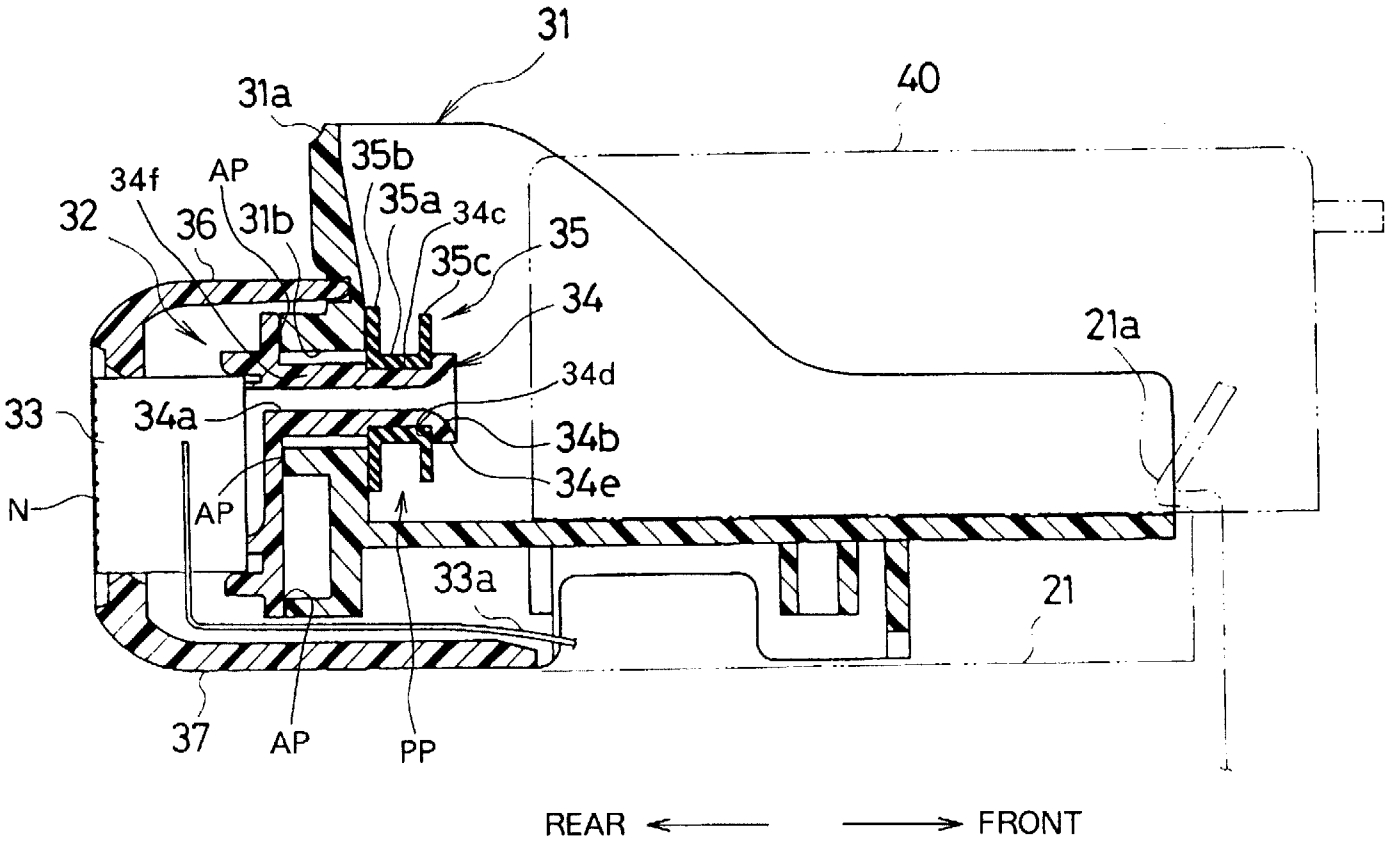
FIG. 4 is a cross-sectional view showing the ink ejection system including an ink-supply connecting member according to the embodiment of the present invention.
Figure 5:
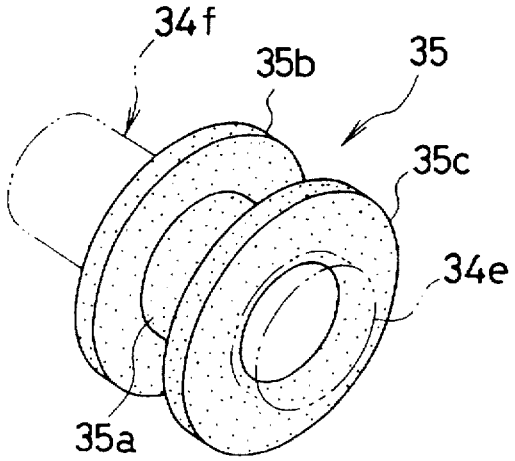
FIG. 5 is a perspective view showing a seal member of the ink-supply connecting member.

Next, an explanation for an ink ejection mechanism 30 for ejecting ink from an ink cartridge 40 toward the print sheet P will be provided while referring FIGS. 2 through 6. As shown in FIG. 4, a box-shaped head holder 31 with upper and front sides open is mounted on the carriage 21. A head unit 32 for ejecting ink is attached to an upright front wall portion 31*a* of the head holder 31. The head unit 32 includes an ink ejection print head 33 and a connecting manifold portion 34 connected integrally to each other.

The print head 33 is formed at its rear surface with a plurality of ejection nozzles N. Although not shown in the drawings, a plurality of ink channels in fluid communication with the ejection nozzles N are formed in the interior of the print head 33. A vibration plate, such as a piezoelectric element, is formed in the middle of each ink channel. A flexible print circuit board 33*a* for supplying drive signals to the piezoelectric elements is connected to each of the piezoelectric elements. An upper and a lower head cover 36, 37 for protecting the print head 33 is attached to the head holder 31.

The connecting manifold portion 34 includes a tubular portion 34*f* formed with an ink-supply passage 34*a* in fluid connection with the plurality of ink channels of the print head 33. The tubular portion 34*f* is fitted in an attachment hole 31*b* formed in the upright wall portion 31*a*. A protruding portion PP protrudes from the attachment hole 31*b* toward the ink cartridge 40. The head 32 is attached to the head holder 31 by a plurality of attachment portions AP.

The protruding portion PP includes a small-diameter tubular portion 34*c* and a large-diameter portion 34*e*. The small-diameter tubular portion 34*c* is formed from an annular groove formed with a predetermined width in the outer periphery of the tubular portion 34*f*. The small-diameter tubular portion 34*c* is sandwiched between the upright wall portion 31*a* and the large-diameter portion 34*e*, which is connected to the small-diameter tubular portion 34*c* via a step portion 34*d* at the cartridge-side tip of the small-diameter tubular portion 34*c*. An ink intake port 34*b* in fluid communication with the ink-supply passage 34*a* is formed in the large-diameter portion 34*e* with a diameter that increases toward the ink cartridge 40.

A seal member 35 for sealing connection between the connecting manifold portion 34 and the ink cartridge 40 is fitted to the outer peripheral surface of the small-diameter tubular portion 34*c*. The seal member 35 is formed from a resilient rubber material such as silicone rubber. As can be best seen in FIGS. 4 and 5, the seal member 35 includes a tubular portion 35*a*, a first flange portion 35*b*, and a second flange portion 35*c*. The tubular portion 35*a* is sealingly fitted to the outer periphery of the small-diameter tubular portion 34*c*.

The first flange portion 35*b* is integrally formed to the tubular portion 35*a* at its rear tip portion, that is, at the side of the tubular portion 35*a* adjacent to and in abutment with the upright wall portion 31*a*. Therefore, the first flange portion 35*b* reliably covers the attachment hole 31*b*. The second flange portion 35*c* is integrally formed with the tubular portion 35*a* at its front tip, that is, at the side of the tubular portion 35*a* confronting the ink cartridge 40. In other words, the front tip of the seal member 35 abuts against the step portion 34*d* so that the seal member 35 is sandwiched between the step portion 34*d* and the upright wall portion 31*a* of the head holder 31.

Further, the second flange portion 35*c* is bendable and fitted around the outer periphery of the tubular portion 35*a*. Therefore, when the ink cartridge 40 is mounted in a manner to be described later with reference to FIG. 7(*a*), the second flange portion 35*c* abuts against the outer surface surrounding the ink-supply port 40*a* and bends toward the tubular portion 35*a*.

Figure 6:
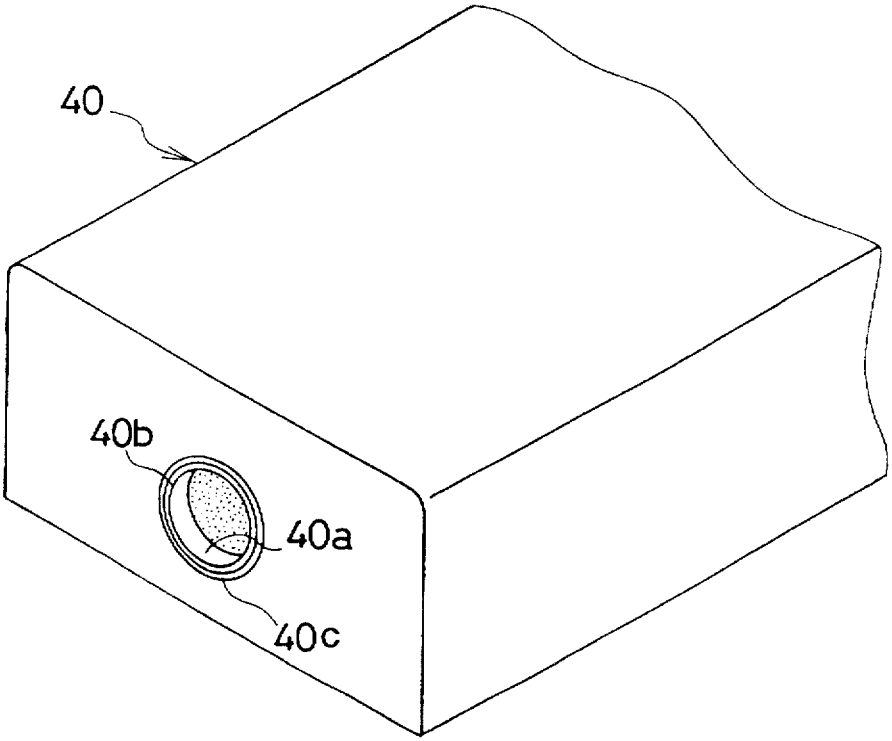
FIG. 6 is a perspective view showing an ink cartridge mounted on the ink-supply connecting member.
Figure 7:
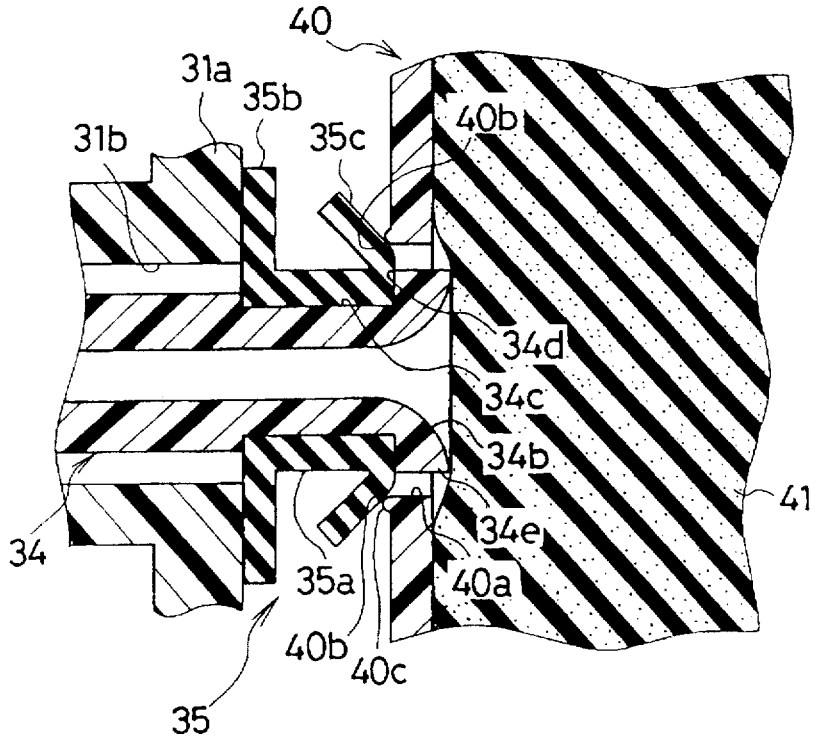
FIG. 7(*a*) is a cross-sectional view showing details of the ink-supply connecting member before the ink cartridge is mounted on the ink-supply connecting member.
Figure 7:
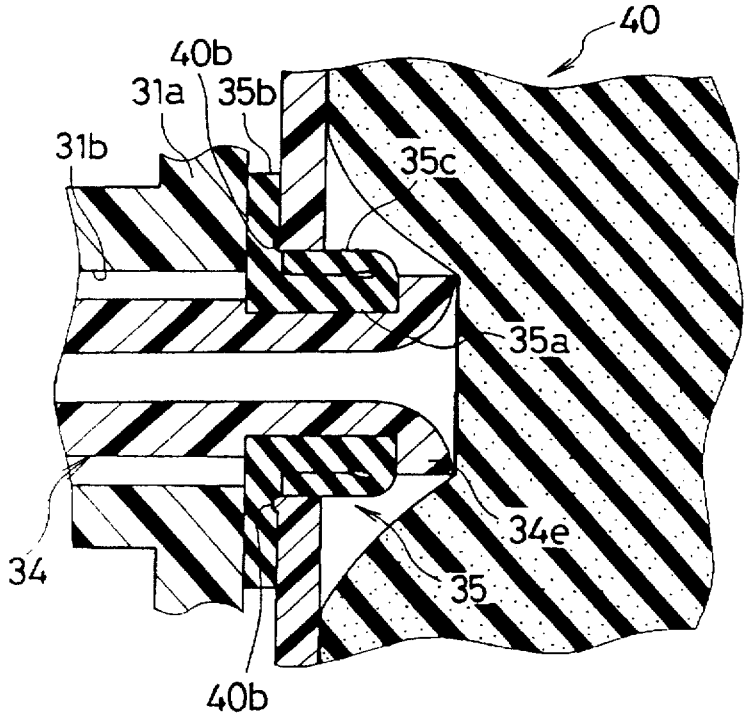

The ink cartridge 40 detachably mounted to the head holder 31 is formed in a box shape from a compound resin. As best seen in FIGS. 6, 7(*a*), and 7(*b*), an ink impregnated body 41 formed from a porous material capable of absorbing and holding ink used for printing is provided internally to the ink cartridge 40. An ink-supply port 40*a* for receiving the connecting manifold portion 34 when the head holder 31 is mounted is formed in the central portion at the rear tip surface of the ink cartridge 40. Further, an annular rib 40*c* is formed around the periphery of the ink-supply port 40*a*. An annular slanting guide surface 40*b* is formed at the inner peripheral surface of the rib 40*c* in connection with the peripheral surface of the ink-supply port 40*a*. When the ink cartridge 40 is mounted, the slanting guide surface 40*b* presses against the base of the second flange portion 35*c* and guides bending of the second flange portion 35*c* toward the tubular portion 35*a*.

Next, the sealing operation of the seal member 35 for preventing ink from leaking out of the ink cartridge 40 when the ink cartridge 40 is mounted to the head holder 31 will be explained. When the ink cartridge 40 is mounted on the head holder 31 as shown in FIG. 4 and moved backward, then, as shown in FIG. 7(*a*), the slanting guide surface 40*b* of the ink cartridge 40 presses the base area of the second flange 35*c* so that the second flange portion 35*c* bends pivotally toward the tubular portion 35*a*.

The slanting guide surface 40*b* facilitates accurate bending of the second flange portion 35*c* so that the second flange portion 35*c* is not damaged. Simultaneously with this, the large-diameter portion 34*e* of the connecting manifold portion 34 is inserted through the ink-supply port 40*a* into the ink cartridge 40. Because the seal member 35 is sealingly fitted to the outer periphery of the small-diameter tubular portion 35c, even when the ink cartridge 40 is moved backward, the seal member 35 will be maintained in its predetermined seal position without sliding backward with movement of the ink cartridge 40.

Next, the ink cartridge 40 is moved further backward so that the slanting guide surface 40b slides from the base portion of the second flange 35c as shown in FIG. 7 (ba past the tip portion at the second flange 35c and into abutment with the first flange 35b as shown in FIG. 7(*b*). In other words, the second flange 35c is pushed by the slanting guide surface 40b while the slanting guide surface 40b slides from its base portion to its tip portion by the slanting guide surface 40b. When the ink cartridge 40 is in this mounted condition on the head holder 31, a latch 21a provided to the rear portion of the carriage 21 presses the ink cartridge 40 toward the upright wall portion 31a. In this condition, the seal member 35 is bent toward the tubular portion 35a by annular rib 40c and is fitted in a compressed condition within the supply port 40a. Said differently, the second flange portion 35a is doubled over on the top of the tubular portion 35a so that the second flange portion 35a is fitted in a compressed condition within the ink-supply port 40a. Therefore, the second flange portion 35c is in intimate contact in a bent condition with the small-diameter tubular portion 34c and the step portion 34d so that ink is prevented from traveling by capillary action into the gap between the small-diameter tubular portion 34c and the tubular portion 35a. This completely prevents ink from leaking out of the ink-supply port 40a.

In this condition, the tip portion of the connecting manifold portion 34 protrudes through the ink-supply port 40a into the ink cartridge 40. The tip portion of the connecting manifold portion 34 partially compresses the ink impregnated body 41 so that ink impregnating the ink impregnated body 41 is supplied to the print head 33 via the ink intake port 34b and the ink-supply passage 34a. However, ink in the ink cartridge 40 cannot seep between the seal member 35 and the small-diameter tubular portion 34c or the step portion 34d of the connecting manifold portion 34. Therefore, ink can be reliably prevented from leaking out of the ink cartridge 40.

At this point, the rib 40c surrounding the ink-supply port 40 presses against the first flange portion 35b so that the first flange portion 35b is compressed between the ink cartridge 40 and the upright wall portion 31a. This seals the gap between the ink cartridge 40 and the attachment hole 31b. Therefore, no ink will leak from the ink-supply port 40a toward the print head 33 via the attachment hole 31b. Corrosion of the contact points on the flexible print circuit board connected with the print head 33 can be prevented.

Because the seal member 35 is fitted around the periphery of the groove forming the small-diameter tubular portion 34c, the outer diameter of the seal member 35 will not be much greater than the outer diameter of the large-diameter portion 34e. As a result, the ink-supply port 40a of the ink cartridge 40 can be made smaller so that leaks can be reliably prevented from occurring when the ink cartridge 40 is attached and detached.

Because the front edge of the seal member 35 abuts against the step portion 34d of the large-diameter portion 34e, when the ink cartridge 40 is disengaged from the head holder 31, the seal member 35 is held in place by the step portion 34d so that the seal member 35 will not slide off the small-diameter tubular portion 34c with the ink cartridge 40.

As mentioned above, the connecting manifold portion 34 is provided with the small-diameter tubular portion 34c and the large-diameter portion 34e. Also, the seal member 35 fitted sealingly around the periphery of the small-diameter tubular portion 34c includes a tubular portion 35a, a first flange portion 35b, and a second flange portion 35c. The first flange portion 35b and the second flange portion 35c are formed integrally to opposite ends of the tubular portion 35a in an axial direction of the tubular portion 35a. Additionally, the seal member 35 is provided so as to abut against the step portion 34d. With this configuration, when the ink cartridge 40 is mounted onto the head holder 31, the second flange 35c will be guided by the slanting guide surface 40b to bend back on itself toward the tubular portion 35a, thereby fitting in a compressed condition within the ink-supply port 40a. The second flange portion 35c will be in intimate contact with the curved surfaces of the small-diameter tubular portion 34c and the step 34d so that ink will be blocked from seeping by capillary action through the gap between the small-diameter tubular portion 34c and the tubular portion 35a.

The seal member 35 provides a seal between the connecting manifold portion 34 and the ink cartridge 40 so that an excellent seal can be achieved by the seal member 35 without using adhesive to adhere the seal member 35. Furthermore, the step portion 34d prevents the seal member 35 from slipping off the connecting manifold portion 34.

The first flange portion 35b also reliably seals the gap between the ink cartridge 40 and the attachment hole 31b. Therefore, ink will not leak from the ink-supply port 40a through the attachment hole 31b toward the print head 33 so that the contact points of the flexible print circuit board 33a connected to the print head 33 will be prevented from corroding.

Because the seal member 35 is fitted to the outer periphery of the small-diameter tubular portion 34c, the outer diameter of the seal member 35 will not be greatly larger than the outer diameter of the large-diameter portion 34e. Therefore, the ink-supply port 40a of the ink cartridge 40 can be made smaller so that ink can be effectively prevented from leaking during attachment and detachment of the ink cartridge 40.

While the invention has been described in detail with reference to specific embodiments thereof, it would be apparent to those skilled in the art that various changes and modifications may be made therein without departing from the spirit of the invention, the scope of which is defined by the attached claims.

Figure 8:
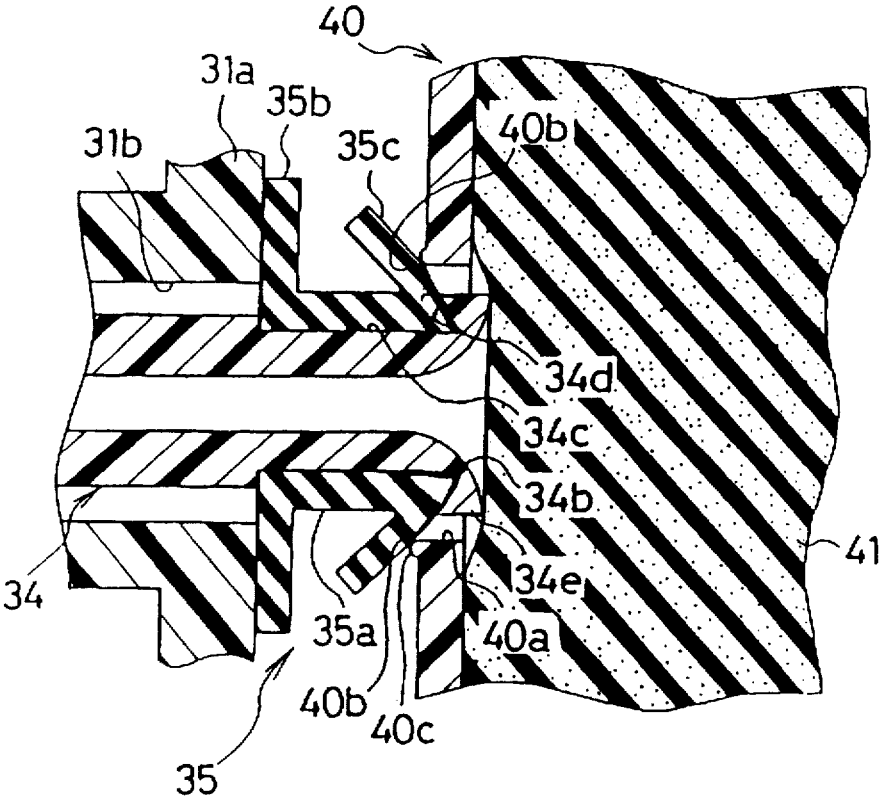
FIG. 8 is a cross-sectional view showing a modification of the configuration shown in FIG. 7(*a*), wherein a step between large and small diameter portions of the ink-supply connecting member is formed in an acute angle.

For example, as shown in FIG. 8 the angle between the small-diameter tubular portion 34c and the step portion 34d of the connecting manifold portion 34 can be formed in an acute angle instead of in a right angle as in the above-described embodiment. Furthermore, the present invention can be applied to a variety of ink jet printers capable of printing in full color.

Also, instead of the small-diameter tubular portion 34c and the large-diameter portion 34e which are circular in cross-section, the connection manifold portion could be provided with a small-diameter tubular portion, and a large-diameter portion, or both having square, rectangular, or other polygonal cross-sections. In this case, "small-diameter" and "large-diameter" would refer to the any or all of the cross-sectional area, the width, and the height of the respective portions. With any of these configurations, the sealing member would be prevented from slipping off the small-diameter tubular portion by the large-diameter portion.

What is claimed is:

1. An ink-supply connecting member for supplying ink from an ink cartridge formed with an ink-supply port to a print head formed with a plurality of jet nozzles, the ink-supply connecting member comprising:

a connection manifold member including:

a small-diameter tubular portion connected to the print head and formed with an ink-supply channel for supplying ink to the jet nozzles of the print head, the small-diameter tubular portion having a small-diameter outer peripheral portion, and a large-diameter tubular portion connected to the small-diameter tubular portion, the large-diameter tubular portion formed with an ink intake port in fluid communication with the ink-supply channel and for introducing ink from the ink cartridge into the ink-supply channel, the large-diameter tubular portion having a large-diameter outer peripheral portion; and a seal member that sealingly fits around the small-diameter tubular portion of the connection manifold member and abuts the large-diameter tubular portion.

2. An ink-supply connecting member as claimed in claim 1, further comprising a head holder and a printhead, wherein the print head and the connection manifold member are in connection with each other and form a head unit.

3. An ink-supply connecting member as claimed in claim 2, wherein:

the head holder is formed with an attachment hole sufficiently large for the large-diameter tubular portion of the connection manifold member to pass through, the print head and the connection manifold member being disposed on opposite sides of the attachment hole; and the seal member includes an integral first flange portion in abutment with the head holder so as to cover the attachment hole and wherein the integral first flange portion abuts a peripheral surface of the ink-supply port of the ink cartridge when the connection manifold member is inserted into the ink-supply port of the ink cartridge.

4. An ink-supply connecting member as claimed in claim 3, wherein the seal member is sandwiched between the head holder and the large-diameter tubular portion of the connection manifold member.

5. An ink-supply connecting member as claimed in claim 4, wherein the seal member further includes:

a seal tubular portion sealingly fitted around the small-diameter tubular portion of the connection manifold member, the seal tubular portion having a first tip and a second tip at opposite ends thereof in an axial direction of the seal tubular portion, the second tip being further in the axial direction from the head holder than the first tip, the first flange portion being formed at the first tip; and a resilient second flange portion formed integrally at the second tip of the seal tubular portion and wherein the resilient second flange portion abuts against an outer periphery of the ink-supply port and bends toward the seal tubular portion when the connection manifold member is received by the ink-supply port of the ink cartridge.

6. An ink-supply connecting member as claimed in claim 5, wherein the second flange portion is guided and bent by a slanting guide surface formed on a peripheral surface of the ink cartridge when the connection manifold member is received by the ink-supply port.

7. An ink-supply connecting member as claimed in claim 3, wherein the seal member further includes:

a seal tubular portion sealingly fitted around the small-diameter tubular portion of the connection manifold member, the seal tubular portion having a first tip and a second tip at opposite ends thereof in an axial direction of the seal tubular portion, the second tip being further in the axial direction from the head holder than the first tip, the first flange portion being formed at the first tip; and a resilient second flange portion formed integrally at the second tip of the seal tubular portion and wherein the resilient second flange portion abuts against an outer periphery of the ink-supply port and bends toward the seal tubular portion when the connection manifold member is received by the ink-supply port of the ink cartridge.

8. An ink-supply connecting member as claimed in claim 7, wherein the second flange portion is guided and bent by a slanting guide surface formed on a peripheral surface of the cartridge when the connection manifold member is received by the ink-supply port.

9. An ink-supply connecting member as claimed in claim 2, further comprising a step formed between the small-diameter tubular portion and the large-diameter tubular portion, the seal member abutting the large-diameter tubular portion at the step.

10. An ink-supply connecting member as claimed in claim 9, wherein the second flange portion is guided and bent by a slanting guide surface formed on an outer peripheral surface of the ink cartridge when the connection manifold member is received by the ink-supply port.

11. An ink-supply connecting member as claimed in claim 2, wherein the seal member is sandwiched between the head holder and the large-diameter tubular portion of the connection manifold member.

12. An ink-supply connecting member as claimed in claim 1, further comprising a step formed between the small-diameter tubular portion and the large-diameter tubular portion, the seal member abutting the large-diameter tubular portion at the step.

13. An ink-supply connecting member as claimed in claim 12, wherein the step is formed in substantially a right angle between the small-diameter tubular portion and the large-diameter tubular portion.

14. An ink-supply connecting member as claimed in claim 12, wherein the step is formed in an acute angle between the small-diameter tubular portion and the large-diameter tubular portion.

15. An ink-supply connecting member as claimed in claim 1, further comprising a print head wherein the print head and the connection manifold member are connected integrally to each other.

16. An ink-supply connecting member as claimed in claim 1, wherein the seal member includes:

a seal tubular portion sealingly fitted around the small-diameter tubular portion of the connection manifold member, the seal tubular portion having a first tip and a second tip at opposite ends thereof in an axial direction of the seal tubular portion; and a resilient flange member formed integrally at the second tip of the seal tubular portion and wherein the resilient second flange portion abuts against an outer periphery of the ink-supply port and bends toward the seal tubular portion when the connection manifold member is received by cartridge.

17. An ink-supply connecting member as claimed in claim 16, wherein the resilient flange member is guided and bent by a slanting guide surface formed on a peripheral surface of the ink cartridge when the connection manifold member is received by the ink-supply port.

18. An ink-supply connecting member as claimed in claim 1, wherein the large-diameter tubular portion of the connection manifold member has a substantially annular shape and sandwiches the small-diameter tubular portion between itself and the print head.

19. An ink-supply connecting member as claimed in claim 1, wherein the seal member protrudes radially beyond the large-diameter tubular portion.

20. An ink ejection system comprising: a print head formed with a plurality of jet nozzles for ejecting ink;

an ink cartridge;

a connection manifold member connected with the print head and including:

a small-diameter tubular portion connected to the print head and formed with an ink-supply channel for supplying ink to the jet nozzles of the print head, the small-diameter tubular portion having a small-diameter outer peripheral portion, and a large-diameter tubular portion connected to the small-diameter tubular portion, the large-diameter tubular portion formed with an ink intake port in fluid communication with the ink-supply channel and for introducing ink from the ink cartridge into the ink-supply channel, the large-diameter tubular portion having a large-diameter outer peripheral portion;

a seal member sealingly fitting into the small-diameter tubular portion of the connection manifold member and abutting the large-diameter tubular portion; and a head holder to which the print head and the connection manifold member are attached, the head holder being formed with an attachment hole sufficiently large for the large-diameter tubular portion of the connection manifold member to pass through, the print head and the connection manifold member being disposed on opposite sides of the attachment hole, wherein said ink cartridge is formed with an ink-supply port receiving the large-diameter portion of the connection manifold member.

21. An ink-supply connecting member as claimed in claim 1, wherein the large-diameter tubular portion of the connection manifold member is inserted further into the ink cartridge than the small-diameter tubular portion when the connection manifold member is inserted into the ink cartridge.

22. An ink-supply connecting member as claimed in claim 20, wherein the large-diameter tubular portion of the connection manifold member is inserted further into the ink cartridge than the small-diameter tubular portion when the connection manifold member is inserted into the ink cartridge.

* * * * *